United States Patent [19]

McSweeney

[11] 4,047,348

[45] Sept. 13, 1977

[54] CEILING SUPPORT GRID SYSTEM

[75] Inventor: Diarmuid Justin McSweeney, Granville, Ohio

[73] Assignee: Johns-Manville Corporation, Denver, Colo.

[21] Appl. No.: 700,289

[22] Filed: June 28, 1976

[51] Int. Cl.[2] ..... E04B 5/52; E04C 2/42

[52] U.S. Cl. ..... 52/484; 52/666; 52/669; 403/178; 403/231; 403/345

[58] Field of Search ..... 52/484, 483, 485, 758 A, 52/665, 489, 668, 669, 667, 487; 403/252, 256, 247, 178, 397, 231, 347, 346, 241, 363

[56] References Cited

U.S. PATENT DOCUMENTS

| | | | |
|---|---|---|---|
| 3,270,479 | 9/1966 | Weinar | 52/484 |
| 3,473,282 | 10/1969 | Robinson | 52/489 |
| 3,640,557 | 2/1972 | Nute et al. | 52/758 X |
| 3,835,614 | 9/1974 | Downing | 52/484 |

FOREIGN PATENT DOCUMENTS

| | | | |
|---|---|---|---|
| 635,717 | 1/1962 | Canada | 52/484 |
| 689,652 | 6/1964 | Canada | 52/758 A |
| 1,184,688 | 2/1959 | France | 403/252 |
| 1,005,866 | 9/1965 | United Kingdom | 52/665 |

*Primary Examiner*—James L. Ridgill, Jr.
*Attorney, Agent, or Firm*—Robert M. Krone; Joseph J. Kelly; Stephen C. Shear

[57] ABSTRACT

A ceiling support grid system is disclosed herein and includes a plurality of longitudinally extending support runners which are interlocked together to form an integral grid pattern, preferably a basketweave pattern. The runners are interlocked together by two separate and distinct but cooperating arangements in a rapid and reliable manner and without the need for separate tools and without bending or otherwise deforming any components associated with these interlocking arrangments.

11 Claims, 9 Drawing Figures

Fig. 2
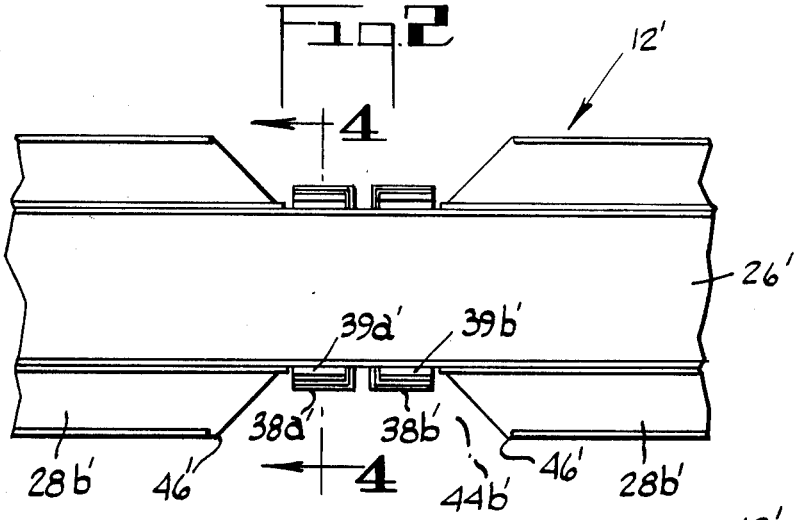
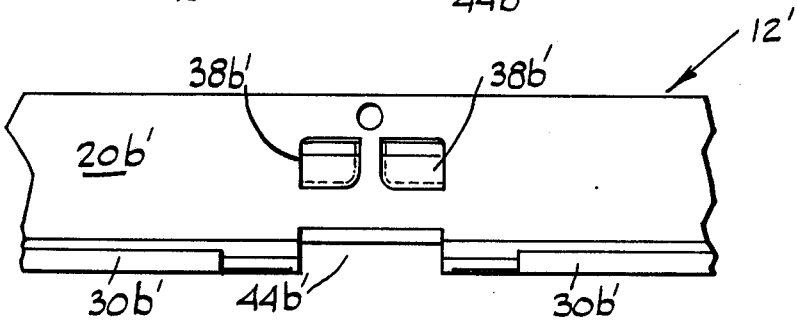
Fig. 3.
Fig. 4.
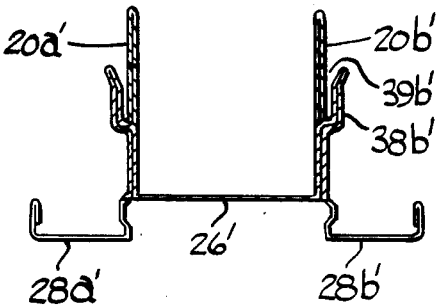
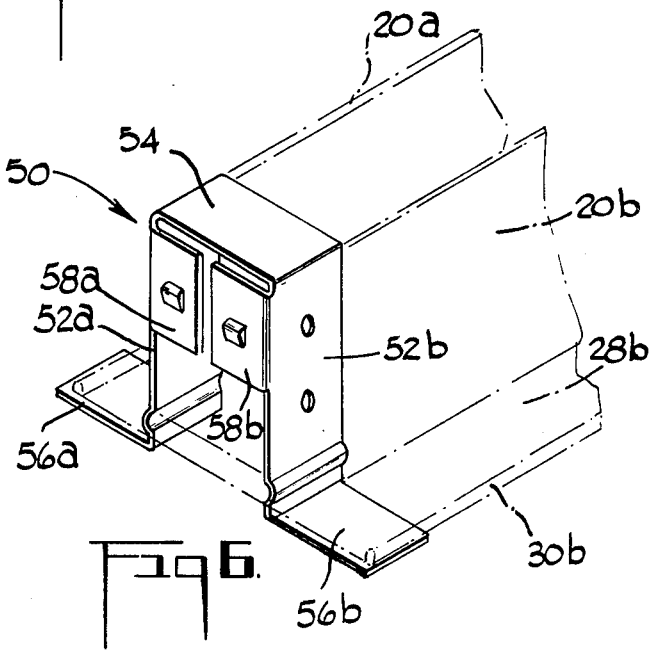
Fig. 6.

Fig. 7.
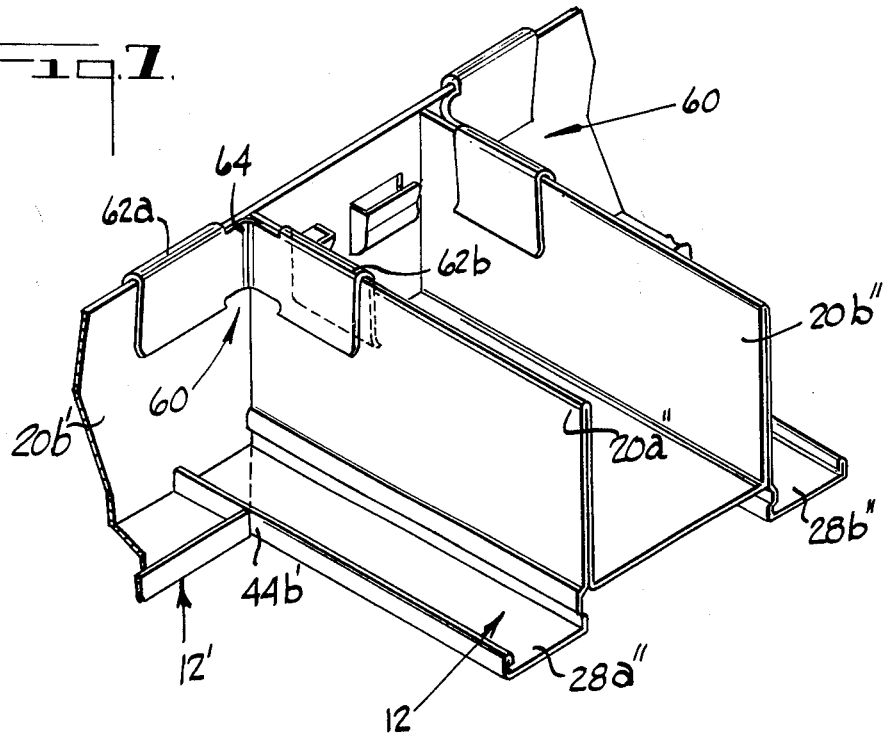
Fig. 8.
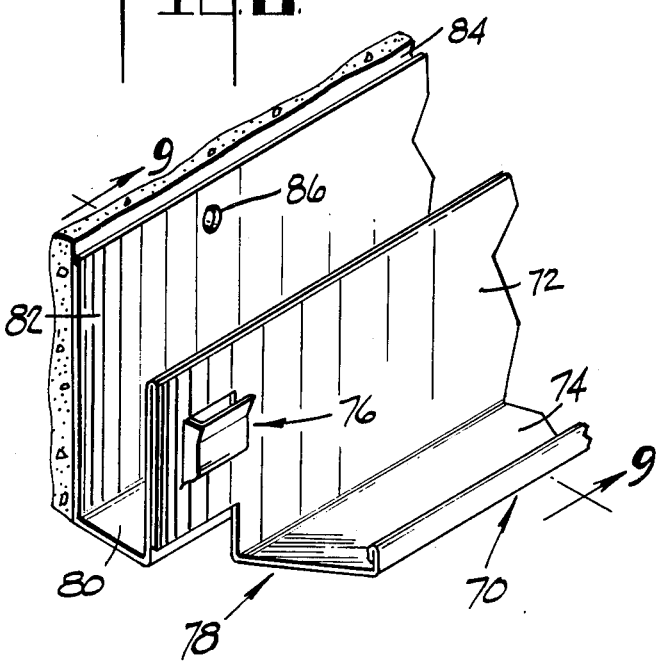
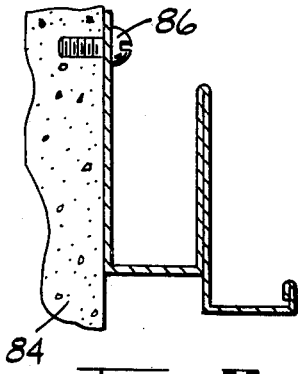
Fig. 9

CEILING SUPPORT GRID SYSTEM

BACKGROUND OF THE INVENTION

The present invention relates generally to ceiling grid systems including individual support runners and more particularly to a specific way in which the runners are interlocked together.

Suspended ceiling systems are well known in the art. A typical system of this general type includes a number of longitudinal runners which interlock together to form an overall grid for supporting ceiling panels or tile, light fixtures and the like. While most of the suspended ceiling systems of the prior art typically include these interlocked runners, the runners themselves and the specific way in which they are interlocked together vary from system to system. For example, in a system disclosed in U.S. Pat. No. 3,292,332 (Jahn), the adjacent ends of colinear runners are interlocked together through transverse runners by means of separate interlocking clips. In a system disclosed in U.S. Pat. No. 3,848,385 (Thompson), the runners, which are entirely different than those used in the Jahn system, are interlocked together in groups of four perpendicular runners by means of a separate central connector. In a system disclosed in U.S. Pat. No. 3,835,614 (Downing), the runners are generally similar to those in the Thompson system. However, in one embodiment of the Downing patent, an end of one given runner is interlocked to an intermediate section of another by means of an upwardly extending tongue. The tongue of the one runner is inserted up into a slot in the other runner and bent back so as to remain in the slot.

While each of these systems may be generally satisfactory for its intended purpose, they all have certain drawbacks relating to the way in which the individual runners are interlocked together. For example, the Jahn system and the Thompson system require separate connector or interlocking arrangements which must be assembled with the runners. Moreover, once all of the runners are interlocked together in either of these two systems, it is very difficult if not impossible to separate an individual runner from the system without separating a number of the runners. While the Downing system referred to above does not include either of these drawbacks, to interlock the runners of this latter system requires that the interlocking tabs be bent back upon themselves. This in and of itself is not believed to be desirable, particularly, inasmuch as it has the tendency of weakening the tab. In addition, to remove a runner (bending the tab back to its original position) and reusing it (again bending the tab) weakens the tab considerably. Another drawback in this embodiment of the Downing system is that any given runner is supported at its interlocked runners only by the bent over tabs.

As will be seen hereinafter, the present invention is directed to a ceiling grid system including a plurality of longitudinally extending support runners which can be interlocked together in a rapid, uncomplicated and reliable way and a way which eliminates the aforediscussed drawbacks.

SUMMARY OF THE INVENTION

One object of the present invention is to provide a ceiling grid system which includes a number of longitudinally extending support runners and means for interlocking the runners together in a rapid and uncomplicated manner.

Another object of the present invention is to provide interlocking means which requires no tools nor bending of any of its components to interlock the support runners together.

Still another object of the present invention is to provide interlocking means which makes it relatively easy to remove an individual support runner, for example, one which becomes damaged, after the entire system of runners has been installed.

A further object of the present invention is to provide interlocking means comprising two separate but cooperating interlocking arrangements for interlocking a given pair of support runners.

Still a further object of the present invention is to provide a relatively uncomplicated and economical way to readily assemble a shortened, cut off end of a support runner to a second runner.

The ceiling grid system disclosed herein includes a plurality of longitudinally extending, preferably identical main support runners constructed in accordance with the present invention and conventional secondary runners for supporting ceiling tile, light fixtures and the like. Each main runner includes a pair of horizontally spaced apart and aligned vertical sidewalls having respective outer surfaces and confronting inner surfaces. These sidewalls are connected together by suitable means, preferably by means of a horizontal base integrally connected with and extending between the inner surfaces of the sidewalls at the bottom edges of their confronting inner surfaces. In addition, each main support runner includes a pair of support flanges respectively connected, preferably intergrally so, with and extending horizontally out from the outer surfaces of the sidewalls at the bottom edges thereof. In accordance with the present invention, these longitudinally extending main support runners are interlocked together by at least one of two particular interlocking arrangements. In a preferred embodiment of the present invention, both interlocking arrangements are utilized in cooperation with one another, specifically to interlock one end of a first runner to a second runner at an intermediate section along the length of the second runner.

In accordance with the present invention, one of these arrangements includes a first interlocking member and a second cooperating member for connecting one end of the first runner to the intermediate section of the second runner. The first interlocking member of this arrangement is connected, preferably intergrally so, with one of the sidewalls of the second support runner at the aforesaid intermediate section and defines an upwardly opening pocket, actually two pockets in the preferred embodiment. The second member, actually a vertical flange, is connected, preferably intergrally so, to one end of the first runner and extends inwardly from the inner surface of one of the sidewalls of the first runner. In addition, it has a bottom edge portion which is spaced above the sidwall connecting means of the first runner, specifically the horizontally extending base. This bottom edge portion is adapted for vertically downward insertion into the pocket defined by the first member. Of course, where two such pockets are provided, the second member will comprise two cooperating vertical flanges.

The second interlocking arrangement of the present invention includes a discontinuation in one of the support flanges of the second runner, specifically the support flange adacent the first interlocking arrangement, at the intermediate section of the second runner. The discontinuation separates the support flange into two sections which are spaced apart a distance approximately equal to the width of the first runner. This second arrangement also includes a pair of interlocking flange segments which are located at the end of the first runner and which interlock with the two sections of the discontinuous support flange of the second runner.

As will become more apparent from a detailed description of these arrangement, to be provided hereinafter, the longitudinally extending support runners of the ceiling grid system constructed in accordance with the present invention can be interlocked together in a rapid, uncomplicated and yet reliable manner without utilizing tools and without bending any of its components. Moreover, once the various runners are interlocked, individual ones can be relatively easily removed if this is desired without removing adjacent support runners.

BRIEF DESCRIPTION OF THE DRAWINGS

FIG. 2 is a plan view illustrating a portion of one runner comprising part of the system of FIG. 1 and particularly illustrating one component of an interlocking arrangement constructed in accordance with the present invention and provided for interlocking together the runners of the ceiling system.

FIG. 3 is a side elevational view of the runner illustrated in FIG. 2

FIG. 4 is a cross-sectional view of the runner illustrated in FIG. 2 taken generally along line 4—4 in FIG. 2.

FIG. 6 is a perspective view of a support runner end cap which is constructed in accordance with the present invention and which may comprise part of the overall system illustrated in FIG. 1.

FIG. 7 is a perspective view of a particular aspect of the system of FIG. 1.

FIG. 8 is a perspective view of another particular aspect of the system of FIG. 1.

FIG. 9 is a sectional view taken generally along line 9—9 in FIG. 8.

DETAILED DESCRIPTION

Figures 1, 5:
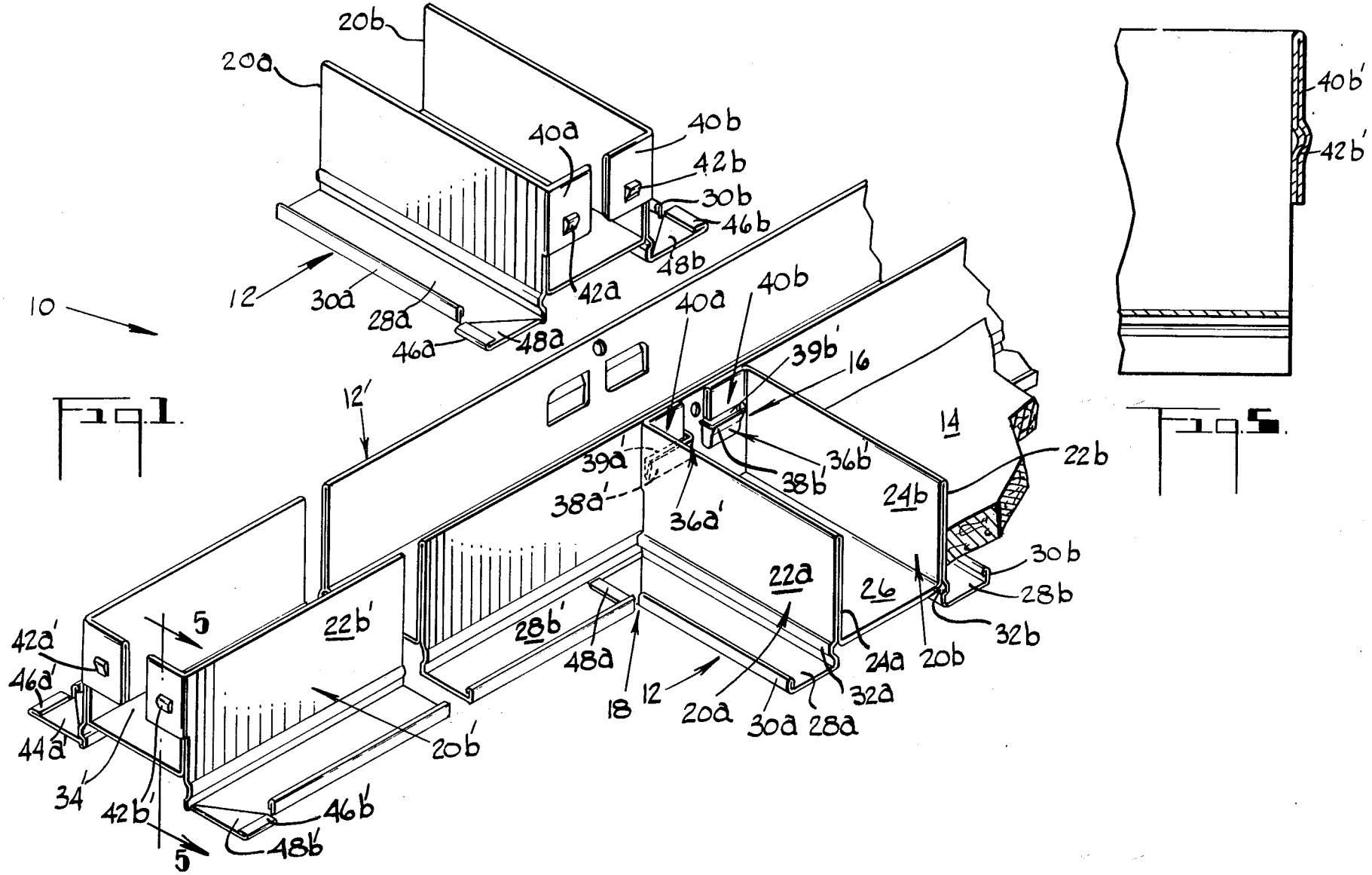
FIG. 1 is a partially exploded perspective view illustrating a portion of a ceiling grid system constructed in accordance with the present invention.
FIG. 5 is a vertical sectional view illustrating a portion of one of the runners in FIG. 1, taken generally along line 5—5 in FIG. 1.

Turning to the drawings, where like components are designated by like reference numerals throughout the various figures, an overall ceiling grid system, specifically a suspended grid system, is illustrated in FIG. 1 and generally designated by the reference numeral 10. This system includes a plurality of longitudinally extending main support runners 12 and 12', preferably identical runners, which are interlocked together to form an interlocking grid, preferably a basketweave type of grid, for supporting ceiling panels or tile, indicated generally at 14, light fixtures (not shown) and the like. These runners may of course be interlocked together in a linear type of pattern and the system may and probably would include secondary runners (not shown) extending across the main runners. Inasmuch as these secondary runners form no part of the present invention perse, a detailed discussion will not be provided. It should suffice to state that any conventional secondary runner may be utilized and conventionally interlocked into the system, such as one having a T-shaped cross-section. As illustrated in FIG. 1, the main runners 12 and 12' (hereinafter referred to merely as "runners") are interlocked in pairs, that is, the end of one runner 12 is interlocked to a second runner 12' at an intermediate section along the length of the second runner. Actually, in order to better illustrate the various components of each runner, two runners 12 have been illustrated in FIG. 1. Of course, as just stated, all three runners illustrated are preferably identical. In accordance with a preferred embodiment of the present invention, the runners are interlocked by means of two separate but cooperating interlocking arrangements associated with the runners to be interlocked together. These arrangements are generally indicated at 16 and 18 in FIG. 1.

In addition to the foregoing, ceiling system 10 includes suitable means (not shown) for suspending the runners to a fixed overhead support (also not shown). For example, specific runners in the overall system or for that matter all of the runners, may be supported by means of overhanging wires attached to the runners and to the overhead support. In addition, the system may include suitable means (not shown) or for specific runners to be described with respect to FIGS. 8 and 9 for connecting cross runners to the vertical end walls defining the room or area in which the system is located.

Each of the longitudinally extending support runners may be constructed of any suitable material but is preferably constructed of rolled or stamped sheet metal or the like, and is preferably an integral unit, that is, it is preferably formed and shaped from a single piece of sheet metal.

Inasmuch as the runners 12 and 12' are identical, a description of the components of one such runner will be applicable to the other. Corresponding components will be designated by like reference numerals and the use of a "prime" will distinguish those components of runners 12' from runner 12. As seen best in FIG. 1, a given support runner 12 includes a pair of horizontally spaced apart and aligned vertical side walls **20*a* and 20*b* having respective outer surfaces 22*a* and 22*b* and respective confronting inner surfaces 24*a* and 24*b*. These sidewalls are joined together by a horizontal base 26 connected with and extending between the inner surfaces 24*a* and 24*b* of the sidewalls at the bottom edges of the confronting inner surfaces. Each support runner also includes a pair of support flanges 28*a* and 28*b* respectively connected with an extending horizontally out from the outer surfaces of sidewalls 20*a* and 20*b* at the bottom edges of the outer surfaces. Each of these flanges includes a vertically upwardly extending outer edge portion 30*a* and 30*b* respectively. As seen best in FIG. 1, outer edge portion 30*a* is in horizontal alignment with and uniformly spaced along its length from the bottom edge portion of surface 22*a* and both the outer edge portion 30*a* and this bottom edge portion of surface 22*a* are preferably located below base 26. This is also true of outer edge portion 30*b* and the bottom edge portion of surface 22*b*. Moreover, sidewalls 22*a* and 22*b* preferably respectively include outwardly protruding, longitudinal ribs 32*a* and 32*b* which are horizontally aligned with portions 30*a* and 30*b* of flanges 28*a* and 28*b*.**

Because of space limitations, the entire length of support runners 12 and, for that matter, support runner 12', have not been illustrated. With certain exceptions to be discussed hereinafter, each support runner is preferably identical at opposite ends, which ends are generally designated by the reference numeral 34 (or 34'). As illustrated in FIG. 1, sidewalls 22a and 22b and base 26 extend the entire length of the support runner from one of its ends 34 to the other. Of course, while not shown, the base may include suitable openings for the passage of conduits, for air flow or the like. Support flanges 28a and 28b do not however extend the entire length of the support runner between ends 34. As will be seen hereinafter, the support flanges include discontinuations along their length for actually separating the support flanges into two sections, and they terminate short of ends 34, both for the purpose of providing interlocking arrangement 18.

As stated previously, each support runner 12 or 12' is preferably formed or shaped from a single piece of sheet metal but of course could be made of other metal for example, aluminum, or other suitable material. As illustrated in FIG. 1 and possibly best in FIG. 4, the sheet metal turns on itself at outer edge portions 30a and 30b of support flanges 28a and 28b to provide double thickness at these outer edge portions. The sheet metal also turns on itself at sidewalls 20a and 20b, except along the lower edge portions of the sidewalls. Hence, each of the sidewalls with the exception of its ribbed bottom edge, is also of double thickness. This configuration not only adds strength to the support runner but facilitates manufacturing the runner into an integral unit.

Having described a support runner 12 and therefore identical support runner 12', attention is now directed to the manner in which two such runners are interlocked together. More specifically, attention is first directed to interlocking arrangement 16. As stated previously, this arrangement is provided for interlocking an end of one runner, for example, end 34 of the interlocked runner 12 in FIG. 1, to a second runner, for example, runner 12', at an intermediate section along the length of the second runner. To accomplish this, arrangement 16 includes a pair of interlocking flange members 36a' and 36b' which are illustrated in FIGS. 1–4. These flange members are connected with one of the sidewalls of runner 12', specifically the sidewall 20b' at the aforesaid intermediate section of runner 12'. These flange members are aligned with one another a predetermined distance above support flange 28b' and are horizontally spaced from one another a distance less than that distance spanning the sidewalls 20a and 20b of runner 12. The interlocking members respectively include upwardly extending segments 38a' and 38b' at least the top edge portions of which are spaced outwardly from outer face 22b' of sidewall 20b'. These pair of flange members are preferably intergrally formed with sidewall 20b. In fact, they are preferably punched or stamped out segments of the sidewall, that is, both thicknesses of the sidewall, by means, for example, a suitable punch press. As can be best seen in FIG. 2, interlocking members 38a' and 38b' define upwardly opening pockets 39a' and 39b' between segments 38a', 38b' and surface 20b'.

Arrangement 16 also includes a pair of second, vertical interlocking flange members 40a and 40b which are respectively connected with an end 34 of connector 12. These second interlocking members respectively extend inwardly towards one another from the inner surface 24a and 24b of sidewalls 20a and 20b of runner 12 and have respective bottom edge portions which are spaced above horizontal base 26. These second flange members are preferably integral with sidewalls 22a and 22b and, as illustrated best in FIG. 1, are bent in 90° from the sidewalls so as to face one another.

As also illustrated best in FIG. 1, an end 34 of runner 12 is interlocked with runner 12', specifically with sidewall 20b' of runner 12', by vertically downwardly inserting the flange members 40a and 40b, at least the bottom edge portions of these flange member, into the spaces or pockets 39a' and 39b' between the flange segments 38a' and 38b' and the sidewall to which these latter flange members are connected, at least between the top edge portions of these latter flange members and the sidewall to which they are connected.

It should be apparent that interlocking arrangement 16 requires no tools and no bending of any components. This arrangement prevents the interlocked support runners from separating horizontally. To prevent the runners from separating vertically, that is, to lock the flange members 40a and 40b in pockets 39a' and 39b', the flange members may include respective outwardly and upwardly extending locking tongues 42a and 42b which are constructed and positioned to first compress in as their associated flange members 40a and 40b are inserted into the pockets and against outer surface 22b' and snap out through the spaces formed by the flange members 36a' and 36b' beyond the inner surface of sidewall 20b'. While these locking tongues do prevent the vertical separation of runners 12 and 12', they, of course, do make it more difficult to separate the runners if this is subsequently desired.

Having described interlocking arrangement 16, attention is now directed to interocking arrangement 18 which, as stated previously, cooperates with arrangement 16 for interlocking end 34 of runner 12 to runner 12', particularly to sidewall 20b' of runner 12'. Arrangement 18 includes a discontinuation 44b' in support flange 28b', as best illustrated in FIGS. 2 and 3. This discontinuation is located at the point of connection between the two runners, that is, at the aforesaid intermediate section, directly below previously described flange members 36a' and 36b'. The discontinuation separates support flange 28b' into two sections which are spaced apart a distance equal to the discontinuation, specifically a distance approximately equal to the width of runner 12 from one outer edge portion 30a of runner 12 to the other outer edge portion 30b. Actually, as best illustrated in FIG. 2, this is the maximum distance of the discontinuation as indicated by points 46' in FIG. 2. The two flange sections defining the discontinuation are preferably mitered inwardly at about 45° from these two points, also illustrated best in FIG. 2.

Returning to FIG. 1, it can also be seen that arrangement 18 includes a pair of interlocking flange segments 48a and 48b located at end 34 of runner 12 (actually all the runners) and respectively connected with support flanges 28a and 28b thereof. These flange segments extend horizontally out from the outer surfaces of sidewalls 22a and 22b of runner 12 and include respective outer edge segments 46a and 46b which are located outwardly beyond the outer edge portions of the support flanges to which they are connected. These outer edge segments are approximately equal in length to the horizontal space between each of the sidewalls of runn 12' and flange edge portions connected therewith. In this way, the outer edge segments can be respectively inserted within these spaces. For example, flange segment 44a can be seen in this positon in FIG. 1.

With the flange segments so positioned, one end of each segment 44a and 44b (not shown) engages against edge portion 30b' of flange 28b' and the other end engages against outer surface 22b' of runner 12' directly under rib 32b'. This prevents runners 12 and 12' from separating horizontally and it aids in preventing the runners from twisting horizontally. Moreover, once runner 12' is suitably supported, the two sections of support flange 28b' of this runner actually aid in supporting end 34 of runner 12. In this regard, to properly align the uppermost edge of runner 12 with the uppermost edge of runner 12', it is necessary to locate the flange segments 44a and 44b a slight distance vertically above the horizontal portions of support flange 28b'. This is, of course, because the flange segments rest on the support flange.

As stated previously, flange segments 44a and 44b are connected to support flanges 28a and 28b. In fact, they are preferably integral parts of the support flanges. More specifically, segments 44a and 44b may be formed by first cutting suitable lengths of upper edge portions 30a and 30b and bending these cut portions out to form outer edges 46a and 46b and then embossing the triangular sections illustrated in FIG. 1, that is, the entire flange segments to provide their upwardly recessed locations.

Having described one interlocking arrangement 16 and cooperating arrangement 18 for interlocking together one end 34 of one runner 12 to one side of runner 12', it is to be understood that all of the runners may be interlocked in this manner. For example, the unassembled runner 12 in FIG. 1 can be readily interlocked to the other side of runner 12' by utilizing identical arrangements 16 and 18. These arrangements are illustrated in FIG. 1 in alignment with the arrangements discussed above so that all three of the runners could be connected together to form a cross. It is to be understood however that the points of connection between the various runners could be provided at any point along the length of the runners, of course, assuming that this is taken into account during the manufacture of the runners.

Turning to FIG. 6, attention is now directed to an end cap which may comprise part of overall system 10 and which is constructed in accordance with the present invention. This end cap, which is generally designated by the reference numeral 50, is used where it is found necessary or desirable to shorten a runner in the field. More specifically, where the installer wishes to shorten a given runner in the field, he merely cuts away one end section of the runner so that the remainder of the runner is of the desired length. However, by doing this, one interocking end of the runner no longer exists. The end cap 50 is used to replace this missing end.

As illustrated in FIG. 6, end cap 50 includes vertical sidewalls 52a and 52b which are horizontally spaced from one another and connected together at their top edges by a horizontally extending top plate 54. The end cap also includes horizontal flanges 56a and 56b which respectively extend outwardly from sidewalls 52a and 52b at the bottom edges thereof.

Sidewalls 52a and 52b are approximately the same length as sidewalls 20a and 20b of any given runner and they are spaced apart from one another a distance slightly greater than the sidewalls of the runner. Flanges 56a and 56b extend out from sidewalls 52a and 52b a distance slightly less than the width of support flanges 28a and 28b of the runner. In this way, the end cap can be tightly fitted over a portion of the cut runner, at its cut end, so that top plate 54 extends across the top of sidewalls 20a and 20b of the runner and so that flanges 56a and 56b fit within the support flanges of the runner between the runners' sidewalls and its outer flange portions 30a and 30b.

As also illustrated in FIG. 6, end cap 50b includes flange members 58a and 58b which for all practical purposes are identical in structure and function to obviously described flange members 40a and 40b to provide part of an interlocking arrangement 16. While not shown, end cap 50 could include flange segments similar in structure and function to previously described segments 44a and 44b. These segments would connect to flanges 56a and 56b and project out and beyond these flanges. While end cap 50 may be constructed of any suitable material, like support runners, it is preferably an integral unit and preferably shaped and formed from a single piece of sheet metal.

Turning to FIG. 7 attention is directed to another way in which a field and shortened runner may be interlocked at its shortened end to one side of another runner. In this case, which is preferred, an end cap is not required. Rather, two clips 60 are used. Each clip includes two inverted U-shaped sections 62a and 62b disposed 90° from one another and integrally formed together by means of an intermediate section 64. Thus latter section is bent 90° to disposed section 62a and 62b at the same angle relative to one another.

As illustrated in FIG. 7, the field cut end of a runner 12" which is otherwise identical to a runner 12 or 12', is positioned against a runner 12' in the same way as runner 12 in FIG. 1. Note that the flanges 28a" and 28b" fit within discontinuation 44b' in runner 12' and that the ends of sidwalls 20a" and 20b" rest against the sidewall 20b' of runner 12'. With the two runners position in this manner, the sections 62a and 62b of each clip 60 snap over the adjoining sidewalls, as shown in FIG. 7. At the same time, the cut end rests on the mitered section of runner 12', which mitered sections define the extent of discontinuation 44b'.

Having discussed the particular aspect of the system as illustrated in FIG. 7, attention is now directed to another aspect of the system. More specifically, attention is directed to FIGS. 8 and 9 which show a main runner 70 which would be utilized directly against a wall. Runner 70 in certain respects is identical to the previously described main runners. For example, it includes a sidewall 72 identical to sidewall 20b' (or 20b) and a support flange 74 identical to support flange 28b'. It includes interlocking arrangements (not shown) identical to arrangements 16 and 18 at some predetermined intermediate point along the length of sidewall 72. Moreover, it includes end arrangements 76 and 78 identical to one-half, for example, the right half of arrangements 16 and 18. In this regard, each end of sidewall 72 includes a 90° flange (not shown) identical to one of the flanges 40a or 40b for interlocking with arrangement 76. It also includes an interlocking flange segment (not shown) identical to one of the segments 48a or 48b which cooperates with arrangement 78.

Runner 70 is different than the other runners in that it does not include an opposite sidewall and associated components. Rather, as illustrated in both FIGS. 8 and 9, runner 70 includes a longitudinally extending horizontal base 80 one-half the width of base 26 and a wall connecting plate 82. This plate extends vertically up from base 80 and, of course, is spaced from sidewall 72. As seen best in FIG. 9, it is positioned against a wall 84 and the entire runner is held in place against the wall by means of screws 86.

What I claim is:

1. A ceiling support arrangement, comprising:

a. a plurality of longitudinally extending support runners, each of which includes i. a pair of horizontally spaced apart and aligned vertical sidewalls having respective outer surfaces and confronting inner surfaces, ii. means joining said sidewalls together, said joining means extending between the inner surfaces of the sidewalls adjacent the bottom edges thereof, and iii. a pair of support flanges respectively connected with the bottom edges of said sidewalls and extending horizontally out from the outer surfaces thereof;

b. means for connecting one end of a first of said runners to a second runner at an intermediate point along the length of said runner, said means including:

i. a first interlocking member connected with one of the said sidewalls of said second support runner at said intermediate point, said interlocking member including an upwardly extending segment having a top edge portion which is spaced outwardly from the outer face of said one sidewall and which is located above the horizontal support flange connected with said one sidewall, and ii. a second, vertical interlocking member connected to one end of said first runner, said second interlocking member extending inwardly from the inner surface of one of the sidewalls of said first runner and having a bottom edge portion which is spaced above the sidewall connecting means of said first runner, said bottom edge portion being adapted for vertically downward insertion into the space between the top edge portion of said first interlocking member and the sidewall to which the first interlocking member is connect; and c. means separate from said first and second interlocking members and located at and connected to said one end of said first runner in a horizontal plane including said support flanges of said first runner, said last-mentioned means being interlocked with a support flange of said second runner at said intermediate point for interlocking said end of said first support runner to the second support runner at said intermediate point along the length of said second runner for preventing said first runner from moving away from said second runner in said horizontal plane and for preventing said first runner from rotating in said plane relative to said second runner.

2. An arrangement according to claim 1 wherein said first interlocking member is an integral punched out segment of said one sidewall of said second runner and wherein said second interlocking member is integral with said one sidewall of said first member.

3. An arrangement according to claim 1 wherein said means for connecting said runners includes an additional first interlocking member connected with said one sidewall of said second support member, said last-mentioned interlocking member being spaced horizontally from said first interlocking member and being substantially indentical thereto, and wherein said connecting means includes an additional second interlocking member connected to said one end of said first runner, said additional second interlocking member extending inwardly from the inner surface of the other sidewall of said first runner and having a bottom edge portion which is spaced above the sidewall connecting means of said first runner, said last-mentioned bottom edge portion being adapted for vertically downward insertion into the space between the top edge portion of said additional first interlocking member and the sidewalls to which the additional first interlocking member is connected.

4. A ceiling support arrangement, comprising:

a. a plurality of longitudinally extending support runners, each of which includes i. a pair of horizontally spaced apart and aligned vertical sidewalls having respective outer surfaces and confronting inner surfaces, ii. means joining said sidewalls together, said joining means extending between the inner surfaces of the sidewalls adjacent the bottom edges thereof, and iii. a pair of support flanges respectively connected with the bottom edges of said sidewalls and extending horizontally out from the outer surfaces thereof, each of said flanges including a vertically upwardly extending outer edge portion; and b. means for interlocking an end of a first one of said runners to a second one of said runners at an intermediate section along the length of said second runner, said interlocking means including i. a discontinuation in one of the support flanges of said second runner at said intermediate section, said discontinuation separating said one support flange into two sections which are spaced apart a distance approximately equal to the width of said first runner from the outer edge of one support flange of said first runner to its other support flange, and ii. a pair of interlocking flange segments located at said end of said first runner and respectively connected with the sidewalls of said first runner adjacent the support flanges thereof, said segments respectively extending horizontally out from the outer surfaces of said last-mentioned sidewalls and including respective outer edge segments which are located outwardly beyond the outer edge portions of adjacent support flanges, said outer edge segments being approximately equal in length to the horizontal distance between the sidewalls of said second runner and the flange outer edge portions connected therewith.

5. An arrangement according to claim 4 including second means separate from said interlocking means for interconnecting said end of said first runner with said intermediate section of said second runner.

6. An arrangement according to claim 4 wherein said interlocking flange segments are respectively integral segments of said adjacent support flanges.

7. An arrangement according to claim 6 wherein said interlocking flange segments are located slightly vertically above the horizontally portions of said adjacent support flanges.

8. A ceiling support arrangement, comprising:

a. a plurality of longitudinally extending support runners, each of which includes i. a pair of horizontally spaced apart and aligned vertical sidewalls having respective outer surfaces and confronting inner surfaces, ii. a horizontal base integrally connected with and extending between the inner surfaces of said sidewalls at the bottom edges of said inner surfaces, and iii. a pair of support flanges respectively integrally connected with and extending horizontally out from the outer surfaces of said sidewalls, each of said flanges including a vertically upwardly extending outer edge portion;

b. first means for interlocking an end of a first on of said runners to a second one of said runners at an intermediate section along the length of said second runner, said first means including i. a pair of first interlocking members integrally connected with one of the sidewalls of said second support runner at said intermediate section, said interlocking members being horizontally spaced from one another and respectively including upwardly extending segments having top edge portions which are spaced outwardly from the outer face of said one sidewall and upwardly from the support flange connected with said one sidewall, and ii. A pair of second, vertical interlocking members respectively integrally connected with said one end of said first runner, said second interlocking members respectively extending inwardly towards one another from the inner surfaces of the sidewalls of said first runner and having respective bottom edge portions spaced above the horizontal base of said first runner, said bottom edge portions being respectively adapted for vertically downward insertion into the spaces between the top edge portions of said first interlocking members and the sidewall to which the first interlocking members are connected; and c. second means for interlocking said one end of said first runner to said intermediate section of said second runner, said second interlocking means including i. a discontinuation in the support flange of said one sidewall of the second runner at said intermediate section and directly below said first interlocking members, said discontinuation separating said last-mentioned support flange into two sections which are spaced apart a distance approximately equal to the width of said first runner from the outer edge portion of one of its support flanges to the outer edge portion of its other support flange, and ii. a pair of interlocking flange segments located at said end of said first runner and respectively integrally connected with the support flanges thereof, said flange segments respectively extending horizontally out from the outer surfaces of the sidewalls of said first runner and including respective outer edge segments which are located outwardly beyond the outer edge portions of the support flanges to which they are integrally connected, said outer edge segments being approximately equal in length to the horizontal space between each of the sidewalls of said second runner and flange edge portion connected therewith, whereby said outer edge segments are respectively adapted for insertion within said last-mentioned spaces.

9. An arrangement, according to claim 8 wherein each of said interlocking flange segments is located slightly vertically above the horizontal portion of the support flange to which it is integrally connected.

10. An arrangement, according to claim 8 wherein the sidewalls, base and support flanges of said first runner all terminate in a vertical plane at the opposite end of said first runner and wherein said system further includes:

c. an end cap adapted for connection with said opposite end of said first runner, said end cap including means for connecting said opposite end of said first runner to an intermediate section of a third runner having interlocking members indentical to said interlocking members integrally connected with said second member.

11. An arrangement according to claim 8 wherein the sidewalls, base and support flanges of said first runner all terminate in a vertical plane at the opposite end of said first runner and wherein said system further includes:

c. a pair of clips for joining said opposite end to or intermediate section of a third runner each of said clips including two inverted U-shaped sections disposed 90° from one another and means joining said sections together, one section of each of said clips being interlocked over a respective sidewall of said first runner at said opposite end and the other section of each clip being interlocked over one of the sidewalls of the third runner at said intermediate section of said third runner.

* * * * *